US008282783B2

(12) United States Patent
Phan et al.

(10) Patent No.: US 8,282,783 B2
(45) Date of Patent: Oct. 9, 2012

(54) PAPERMAKING BELT HAVING A PERMEABLE REINFORCING STRUCTURE

(75) Inventors: Dean Van Phan, West Chester, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 306 days.

(21) Appl. No.: 12/772,320

(22) Filed: May 3, 2010

(65) Prior Publication Data

US 2011/0265966 A1 Nov. 3, 2011

(51) Int. Cl.
*D21F 1/10* (2006.01)
*D21H 27/40* (2006.01)

(52) U.S. Cl. ..... 162/348; 162/116; 162/362

(58) Field of Classification Search ..... 162/116, 162/117, 348, 358.2, 900–904, 361, 362
See application file for complete search history.

(56) References Cited

U.S. PATENT DOCUMENTS

| | | | | |
|---|---|---|---|---|
| 3,301,746 | A | 1/1967 | Sisson | |
| 3,573,164 | A | 3/1971 | Friedberg et al. | |
| 3,905,863 | A | 9/1975 | Ayers | |
| 3,994,771 | A | 11/1976 | Morgan, Jr. et al. | |
| 4,191,069 | A | 3/1980 | Sasso | |
| 4,239,065 | A | 12/1980 | Trokhan | |
| 4,440,597 | A | 4/1984 | Wells et al. | |
| 4,514,345 | A | 4/1985 | Johnson et al. | |
| 4,528,239 | A | 7/1985 | Trokhan | |
| 4,529,480 | A | 7/1985 | Trokhan | |
| 4,637,859 | A | 1/1987 | Trokhan | |
| 4,919,756 | A | 4/1990 | Sawdai | |
| 5,098,522 | A | 3/1992 | Smurkoski et al. | |
| 5,260,171 | A | 11/1993 | Smurkoski et al. | |
| 5,260,345 | A | 11/1993 | DesMarais et al. | |
| 5,274,930 | A | 1/1994 | Ensign et al. | |
| 5,275,700 | A | 1/1994 | Trokhan | |
| 5,277,761 | A | 1/1994 | Van Phan et al. | |
| 5,328,565 | A | 7/1994 | Rasch et al. | |
| 5,334,289 | A | 8/1994 | Trokhan et al. | |
| 5,431,786 | A | 7/1995 | Rasch et al. | |
| 5,443,691 | A | 8/1995 | Phan et al. | |
| 5,496,624 | A | 3/1996 | Stelljes, Jr. et al. | |
| 5,500,277 | A | 3/1996 | Trokhan et al. | |
| 5,514,523 | A | 5/1996 | Trokhan et al. | |
| 5,554,467 | A | 9/1996 | Trokhan et al. | |
| 5,566,724 | A | 10/1996 | Trokhan et al. | |
| 5,624,790 | A | 4/1997 | Trokhan et al. | |
| 5,625,222 | A | 4/1997 | Yoneda et al. | |
| 5,625,961 | A | 5/1997 | Ensign et al. | |
| 5,628,876 | A | 5/1997 | Ayers et al. | |
| 5,679,222 | A | 10/1997 | Rasch et al. | |
| 5,714,041 | A | 2/1998 | Ayers et al. | |
| 2004/0084167 | A1* | 5/2004 | Vinson et al. | 162/348 |
| 2006/0088697 | A1* | 4/2006 | Manifold et al. | 428/174 |

* cited by examiner

*Primary Examiner* — Eric Hug
(74) *Attorney, Agent, or Firm* — Peter D. Meyer

(57) ABSTRACT

A papermaking belt having an embryonic web contacting surface for carrying an embryonic web of paper fibers and a non-embryonic web contacting surface opposite said embryonic web contacting surface is disclosed. The papermaking belt comprises a reinforcing structure having a patterned framework disposed thereon. The patterned framework has a continuous network region and a plurality of discrete deflection conduits. The deflection conduits are isolated one from another by the continuous network region. A plurality of pores is randomly disposed within the continuous network region. The pores have one opening disposed upon the embryonic web contacting surface and one opening disposed upon the non-embryonic web contacting surface. Each of the pores provides at least one pathway between the embryonic web contacting surface and the non-embryonic web contacting surface.

18 Claims, 4 Drawing Sheets

PAPERMAKING BELT HAVING A PERMEABLE REINFORCING STRUCTURE

FIELD OF THE INVENTION

The present invention is related to papermaking belts having an increased de-watering capability that are useful in papermaking machines for making low density, soft, absorbent paper products. More particularly, this invention is concerned with papermaking belts comprising a patterned framework having deflection conduits, random pores, and a reinforcing structure and the high caliper/low density paper products produced thereby.

BACKGROUND OF THE INVENTION

Cellulosic fibrous structures, such as paper towels, facial tissues, napkins and toilet tissues, J are a staple of every day life. The large demand for and constant usage of such consumer products has created a demand for improved versions of these products and, likewise, improvement in the methods and speed of their manufacture. Such cellulosic fibrous structures are manufactured by depositing an aqueous cellulosic slurry from a headbox onto a Fourdrinier wire or a twin wire paper machine. Either such forming wire is provided as an endless belt through which initial dewatering occurs and fiber rearrangement takes place.

Processes for the manufacture of paper products generally involve the preparation of an aqueous slurry of cellulosic fibers and subsequent removal of water from the slurry while contemporaneously rearranging the fibers to form an embryonic web. Various types of machinery can be employed to assist in the dewatering process. A typical manufacturing process employs the aforementioned Fourdrinier wire papermaking machine where a paper slurry is fed onto a surface of a traveling endless wire where the initial dewatering occurs. In a conventional wet press process, the fibers are transferred directly to a capillary de-watering belt where additional dewatering occurs. In a structured web process, the fibrous web is subsequently transferred to a papermaking belt where rearrangement of the fibers is carried out.

A preferred papermaking belt in a structured process has a foraminous woven member surrounded by a hardened photosensitive resin framework. The resin framework can be provided with a plurality of discrete, isolated channels known as deflection conduits. Such a papermaking belt can be termed a deflection member because the papermaking fibers deflected into the conduits become rearranged upon the application of a differential fluid pressure. The utilization of the belt in the papermaking process provides the possibility of creating paper having certain desired characteristics of strength, absorption, and softness. Such a papermaking belt is disclosed in U.S. Pat. No. 4,529,480.

Deflection conduits can provide a means for producing a Z-direction fiber orientation by enabling the fibers to deflect along the periphery of the deflection conduits as water is removed from the aqueous slurry of cellulosic fibers. The total fiber deflection is dependent on the size and shape of the deflection conduits relative to the fiber length. Large conduits allow smaller fibers to accumulate in the bottom of the conduit which in turn limits the deflection of subsequent fibers depositing therein. Conversely, small conduits allow large fibers to bridge across the conduit opening with minimal fiber deflection. Deflection conduits defined by a periphery forming sharp corners or small radii increase the potential for fiber bridging which minimizes fiber deflection. Examples of various conduit shapes that can effect fiber bridging are described in U.S. Pat. No. 5,679,222.

As the cellulosic fibrous web is formed, the fibers are predominantly oriented in the X-Y plane of the web thereby providing negligible Z-direction structural rigidity. In a wet press process, as the fibers oriented in the X-Y plane are compacted by mechanical pressure, the fibers are pressed together increasing the density of the paper web while decreasing the thickness. In contrast, in a structured process, the orientation of fibers in the Z-direction of the web enhances the web's Z-direction structural rigidity and its corresponding resistance to mechanical pressure. Accordingly, maximizing fiber orientation in the Z-direction maximizes caliper.

A paper produced according to a structured web process can be characterized by having two physically distinct regions distributed across its surfaces. One region is a continuous network region which has a relatively high density and high intrinsic strength. The other region is one which is comprised of a plurality of domes which are completely encircled by the network region. The domes in the latter region have relatively low densities and relatively low intrinsic strength compared to the network region.

The domes are produced as fibers fill the deflection conduits of the papermaking belt during the papermaking process. The deflection conduits prevent the fibers deposited therein from being compacted as the paper web is compressed during a drying process. As a result, the domes are thicker having a lower density and intrinsic strength compared to the compacted regions of the web. Consequently, the caliper of the paper web is limited by the intrinsic strength of the domes. Such a formed paper is described in U.S. Pat. No. 4,637,859.

After the initial formation of the web, which later becomes the cellulosic fibrous structure, the papermaking machine transports the web to the dry end of the machine. In the dry end of a conventional machine, a press felt compacts the web into a single region of cellulosic fibrous structure having uniform density and basis weight prior to final drying. The final drying can be accomplished by a heated drum, such as a Yankee drying drum, or by a conventional de-watering press. Through air drying can yield significant improvements in consumer products. In a through-air-drying process, the formed web is transferred to an air pervious through-air-drying belt. This "wet transfer" typically occurs at a pick-up shoe, at which point the web may be first molded to the topography of the through air drying belt. In other words, during the drying process, the embryonic web takes on a specific pattern or shape caused by the arrangement and deflection of cellulosic fibers. A through air drying process can yield a structured paper having regions of different densities. This type of paper has been used in commercially successful products, such as Bounty® paper towels and Charming bath tissue. Traditional conventional felt drying does not produce a structured paper having these advantages. However, it would be desirable to produce a structured paper using conventional drying at speeds equivalent to, or greater than, a through air dried process.

Once the drying phase of the papermaking process is finished, the arrangement and deflection of fibers is complete. However, depending on the type of the finished product, paper may go through additional processes such as calendering, softener application, and converting. These processes tend to compact the dome regions of the paper and reduce the overall thickness. Thus, producing high caliper finished paper products having two physically distinct regions requires forming cellulosic fibrous structures in the domes having a resistance to mechanical pressure.

To sufficiently dewater a paper web, such systems must operate at undesirable, low speeds. Thus, the present invention provides a deflection member that has higher porosity and better dewatering. The present invention provides a web patterning apparatus suitable for making structured paper on conventional papermaking equipment without the need for an additional dewatering felt or compression nip. The present invention also provides a paper web having an essentially continuous, essentially, macroscopically mono-planar network region and a plurality of discrete domes dispersed throughout. The domes are sized and shaped to yield optimum caliper. Additionally, the present invention provides a papermaking belt having a continuous network region and a plurality of discrete deflection conduits which are sized and shaped to optimize fiber deflection and corresponding Z-direction fiber orientation. The present invention also provides the papermaking belt with increased de-watering capability by providing randomly created pores within the continuous network region.

SUMMARY OF THE INVENTION

One embodiment of the present disclosure provides for a papermaking belt having an embryonic web contacting surface for carrying an embryonic web of paper fibers and a non-embryonic web contacting surface opposite said embryonic web contacting surface is disclosed. The papermaking belt comprises a reinforcing structure having a patterned framework disposed thereon. The patterned framework has a continuous network region and a plurality of discrete deflection conduits. The deflection conduits are isolated one from another by the continuous network region. A plurality of pores is randomly disposed within the continuous network region. The pores have one opening disposed upon the embryonic web contacting surface and one opening disposed upon the non-embryonic web contacting surface. Each of the pores provides at least one pathway between the embryonic web contacting surface and the non-embryonic web contacting surface.

Another embodiment of the present disclosure provides for a papermaking belt having an embryonic web contacting surface for carrying an embryonic web of papermaking fibers and a non-embryonic web contacting surface opposite thereto. The papermaking belt comprises a reinforcing structure having a patterned framework disposed thereon. The patterned framework comprises a continuous network region and a plurality of discrete deflection conduits. The deflection conduits are isolated one from another by the continuous network region. A blowing agent is disposed within the continuous network region. Activation of the blowing agent forms a plurality of random pores within the continuous network region. The pores having at least one opening disposed upon the embryonic web contacting surface and at least one opening disposed upon the non-embryonic web contacting surface. Each of the pores defines at least one pathway between the embryonic web contacting surface and the non-embryonic web contacting surface Yet another embodiment of the present disclosure provides for a papermaking belt having an embryonic web contacting surface for carrying an embryonic web of papermaking fibers and a non-embryonic web contacting surface opposite thereto. The papermaking belt comprises a reinforcing structure having a patterned framework disposed thereon. The patterned framework has a continuous network region and a plurality of discrete deflection conduits. The deflection conduits are isolated one from another by said continuous network region. A plurality of pores is randomly disposed within the continuous network region. The pores have at least one opening disposed upon the embryonic web contacting surface and at least one opening disposed upon the non-embryonic web contacting surface. Each of the pores provides at least one pathway between the embryonic web contacting surface and the non-embryonic web contacting surface.

DETAILED DESCRIPTION OF THE INVENTION

In order to meet the needs of the consumer, cellulosic fibrous webs preferably exhibit several characteristics. The cellulosic webs preferably have sufficient tensile strength to prevent the structures from tearing or shredding during ordinary use or when relatively small tensile forces are applied. The cellulosic webs are preferably absorbent, so that liquids may be quickly absorbed and fully retained by the fibrous structure. Further, the web preferably exhibits softness, so that it is tactilely pleasant and not harsh during use. Softness is the ability of the cellulosic fibrous web to impart a particularly desirable tactile sensation to the user's skin. Softness is universally proportional to the ability of the cellulosic fibrous web to resist Z-direction deformation.

Absolute Void Volume ($VV_{Absolute}$) is the volumetric measure of VV per unit area in $cm^3/cm^2$.

Absorbency is the property of the cellulosic fibrous web which allows it to attract and retain contacted fluids. Absorbency is influenced by the density of the cellulosic fibrous web. If the web is too dense, the interstices between fibers may be too small and the rate of absorption may not be great enough for the intended use. If the interstices are too large, capillary attraction of contacted fluids is minimized preventing fluids from being retained by the cellulosic fibrous web due to surface tension limitations.

Aspect Ratio is the ratio of the major axis length to the minor axis length.

Basis weight (BW) is the mass of cellulosic fibers per unit area ($g/cm^2$) of a cellulosic web.

Caliper is the apparent thickness of a cellulosic fibrous web measured under a certain mechanical pressure and is a function of basis weight and web structure. Strength, absorbency, and softness are influenced by the caliper of the cellulosic fibrous web.

A capillary dewatering member is a device for removing water through capillary action.

Cross Machine direction (CD) is the direction perpendicular and co-planar with the machine direction.

A hydraulic connection is a continuous link formed by water or other liquid.

Machine direction (MD) is the direction parallel to the flow of a web material through the papermaking equipment.

Mean fiber length is the length weighted average fiber length.

Relative Void Volume ($VV_{Relative}$) is the ratio of VV to the total volume of space occupied by a given sample.

Tensile strength is the ability of the cellulosic fibrous web to retain its physical integrity during use. Tensile strength is a function of the basis weight of the cellulosic fibrous web.

Void volume (VV) is the open space providing a path for fluids.

The Z-direction is orthogonal to both the MD and CD.

Papermaking Machine and Process

Figure 1:
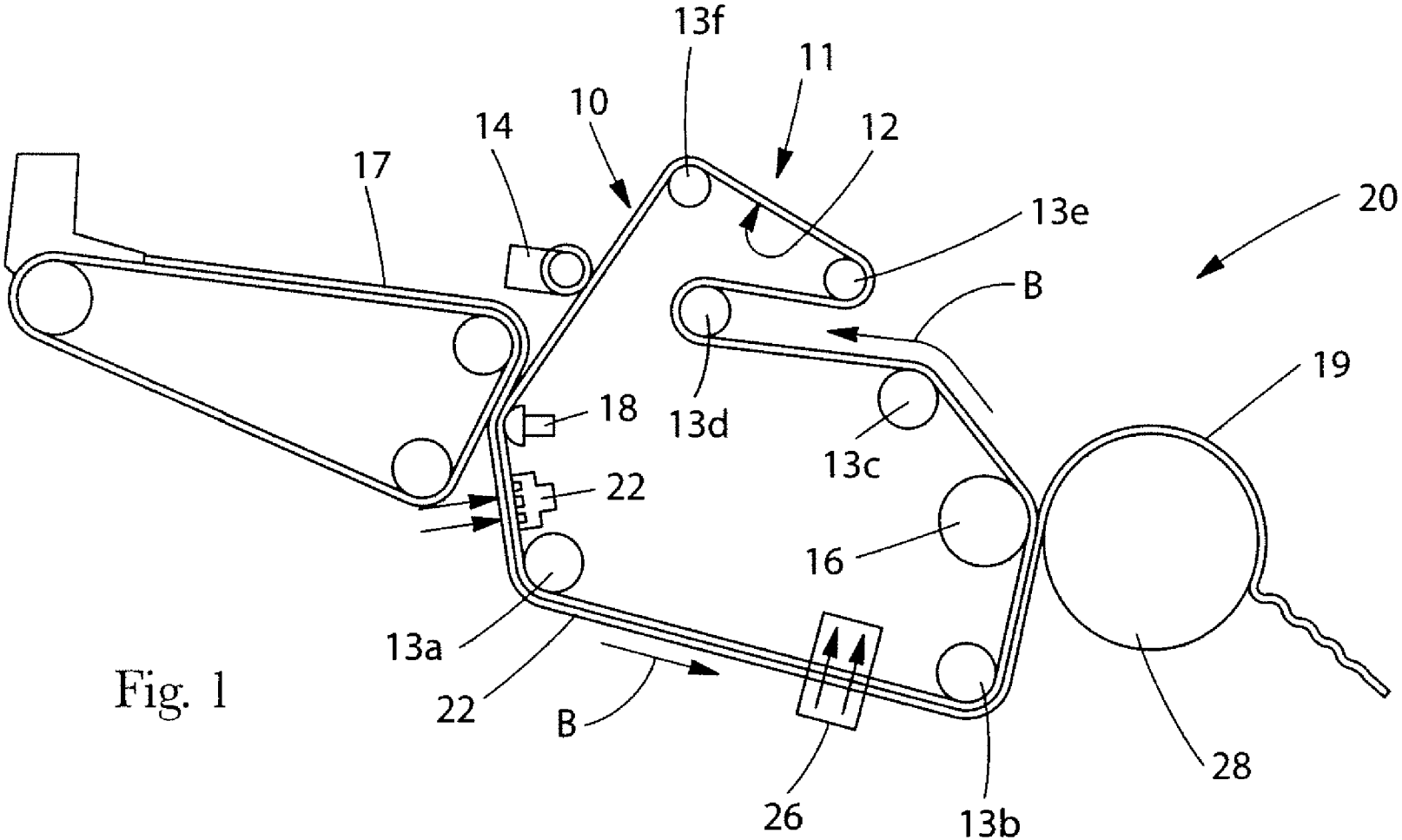
FIG. 1 is a schematic side elevational view of an exemplary papermaking machine that uses the papermaking belt of the present invention.

In FIG. 1, an exemplary papermaking belt 10 used in a papermaking machine 20 is provided as an endless belt. The papermaking belt 10 has an embryonic web contacting side 11 (also referred to herein as the "embryonic web contacting surface 11") and a backside 12 (also referred to herein as the "non-embryonic web contacting side 12" or the "non-embryonic web contacting surface 12") opposite the embryonic web contacting side 11. The papermaking belt 10 can carry and support a web of papermaking fibers (or "fiber web" and/or "fibrous web") in various stages of its formation (an embryonic web 17 and/or an intermediate web 19). Exemplary processes of forming embryonic webs 17 are described in U.S. Pat. Nos. 3,301,746 and 3,994,771. The papermaking belt 10 travels in the direction indicated by directional arrow B around the return rolls 13*a* and 13*b*, impression nip roll 16, return rolls 13*c*, 13*d*, 13*e*, 13*f*, and emulsion distributing roll 14. The loop around which the papermaking belt 10 travels includes a means for applying a fluid pressure differential to the embryonic web 17, such as vacuum pickup shoe 18 and multi-slot vacuum box 22. In FIG. 1, the papermaking belt 10 also travels around a pre-dryer such as blow-through dryer 26, and passes between a nip formed by the impression nip roll 16 and a Yankee drying drum 28.

Although the preferred embodiment of the papermaking belt 10 of the present invention is in the form of an endless belt 10, it can be incorporated into numerous other forms which include, for instance, stationary plates for use in making hand sheets or rotating drums for use with other types of continuous process. Regardless of the physical form which the papermaking belt 10 takes for the execution of the claimed invention, it is generally provided with the physical characteristics detailed infra.

Figure 2:
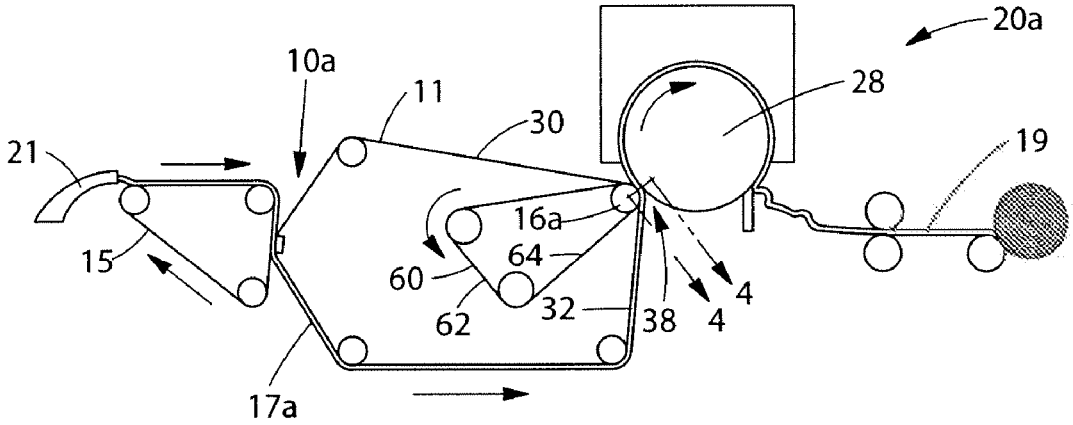
FIG. 2 is a schematic side elevational view of another exemplary papermaking machine that uses the papermaking belt of the present invention.

Alternatively, FIG. 2 provides an alternative papermaking machine 20*a* using a papermaking belt 10*a* for dewatering an embryonic web 17*a*. An aqueous slurry comprising cellulosic fibers and water is discharged from a headbox 21 onto a forming wire 15 and then transferred to a drying apparatus comprising a papermaking belt 10*a*. The papermaking belt 10*a* carries the embryonic web 17*a* to a nip 38 formed between two coaxial rolls. The first roll can be heated roll such as a Yankee drying drum 28. The impression nip roll 16*a* can be a pressure roll having a periphery with a capillary dewatering member 60 disposed thereon. The capillary dewatering member 60 can be a felt and the impression nip roll 16*a* can be a vacuum pressure roll.

An exemplary capillary dewatering member 60 has a top surface 62 and a bottom surface 64. In the nip 38, the bottom surface 64 of the capillary dewatering member 60 interfaces with the impression nip roll 16*a* while the top surface 62 interfaces with a backside 12 of the papermaking belt 10*a* so that the embryonic web 17*a* carried on the embryonic web contacting side 11 of the papermaking belt 10*a* interfaces with the Yankee drying drum 28. The nip 38 compresses the capillary dewatering member 60, papermaking belt 10*a*, and embryonic web 17 combination, effectively squeezing water from the embryonic web 17, through the papermaking belt 10*a* to the capillary dewatering member 60. At the same time, the papermaking belt 10*a* imprints the embryonic web 17 with the pattern disposed upon the papermaking belt 10*a* while transferring the embryonic web 17 to the Yankee drying drum 28.

If desired, a vacuum may be applied through the impression nip roll 16*a* to the capillary dewatering member 60. This vacuum can assist in water removal from the capillary dewatering member 60 and the embryonic web 17*a* through the papermaking belt 10*a*. The impression roll 16*a* may be a vacuum pressure roll. A steam box is preferably disposed opposite the impression nip roll 16*a*. The steam box ejects steam through the embryonic web 17*a*. As the steam passes through and/or condenses in the embryonic web 17*a*, it elevates the temperature and reduces the viscosity of water contained within the embryonic web 17*a* thereby enhancing dewatering of the embryonic web 17*a* while enhancing the hydraulic connection between the embryonic web 17*a* and the dewatering member 60. The steam and/or condensate can be collected by the vacuum impression nip roll 16*a*.

One of ordinary skill will recognize that the simultaneous imprinting, dewatering, and transfer operations may occur in embodiments other than those using a Yankee drying drum 28. For example, two flat surfaces may be juxtaposed to form an elongate nip 38 therebetween. Alternatively, two unheated rolls may be utilized. The rolls may be, for example, part of a calendar stack, or an operation which prints a functional additive onto the surface of the web. Functional additives may include: lotions, emollients, dimethicones, softeners, perfumes, menthols, combinations thereof, and the like.

It has been found that for a given papermaking belt 10*a*, the amount of water removed from the embryonic web 17*a* in the nip 38 is directly related to the hydraulic connection formed between the embryonic web 17*a*, the papermaking belt 10*a*, and the capillary dewatering member 60. The papermaking belt 10*a* has an absolute void volume that can be designed to optimize this hydraulic connection and maximize water removal from the embryonic web 17*a*.

Figure 3:
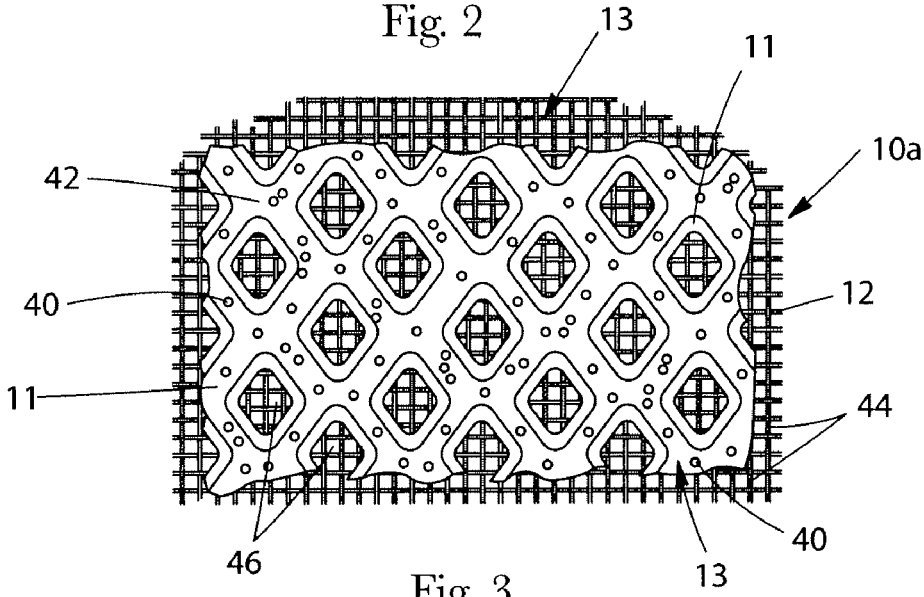
FIG. 3 is a fragmentary top plan view of an exemplary papermaking belt.
Figure 4:
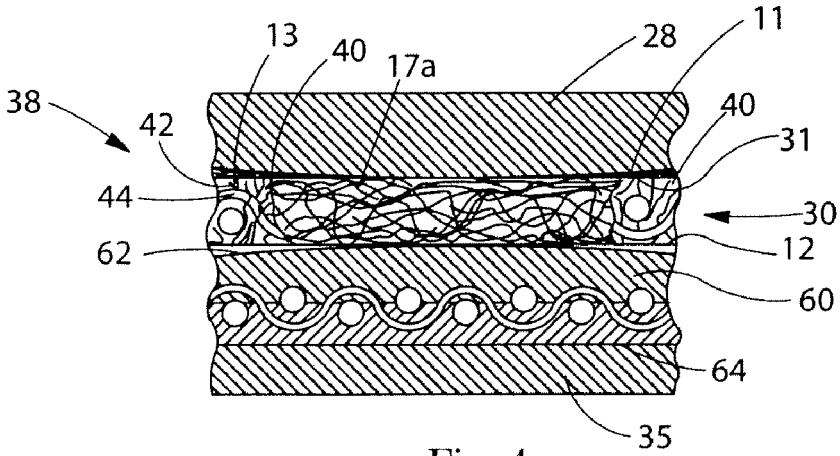
FIG. 4 is a vertical sectional view taken along the line 4-4 of FIG. 2.

As shown in FIG. 3, an exemplary papermaking belt 10*a* provides the woven fabric as a reinforcing structure 44 for a resinous knuckle pattern 42. FIG. 4 illustrates a cross section of a unit cell of an exemplary papermaking belt 10*a* in a compression nip 38 formed between a Yankee drying drum 28 and a impression nip roll 16*a*. The papermaking belt 10*a* has an embryonic web contacting side 11 in contacting relationship with the embryonic web 17*a* and a back side 12 in contacting relationship with a capillary dewatering member 60. The present embodiment provides for a resinous knuckle pattern 42 that defines deflection conduits 46 and pores 40 distributed through the resinous knuckle pattern 42. The capillary dewatering member 60 preferably comprises a dewatering felt. In the nip 38, the resinous knuckle pattern 42 compresses the embryonic web 17, compacts the fibers of the embryonic web 17*a*, and simultaneously forces any water contained within the embryonic web 17*a* into the deflection conduits 46 and pores 40 of papermaking belt 10*a*. In the deflection conduits 46, water removed from the embryonic web 17*a* flows through the absolute void volume of the reinforcing structure 44 thereby forming a hydraulic connection with the capillary dewatering member 60. In the pores 40 disposed within the resinous knuckle pattern 42, the water removed from the embryonic web 17*a* also flows through the absolute void volume of the reinforcing structure 44 forming a hydraulic connection with the capillary dewatering member 60. The cellulosic fibers of the embryonic web 17*a* become captured by the solid volume of the reinforcing structure 44 forming low density pillow areas in the embryonic web 17*a*.

The amount of water in an embryonic web 17*a* is evaluated in terms of consistency which is the percentage by weight of cellulosic fibers making up a web of fibers and water. Consistency is determined by the following expression:

$$\text{Consistency} = \frac{\text{g of Fibers}}{\text{g of Fibers} + \text{g of Water}}$$

and $$\frac{\text{g of Water}}{\text{g of Fiber}} = \frac{1}{\text{Consistency}} - 1$$

Upon entering the nip 38, an embryonic web 17*a* can have an ingoing consistency of about 0.22 comprising about 4.54 g of water/g of fibers. The desired consistency for an embryonic web 17*a* exiting the nip 38 is about 0.40 comprising about 2.50 g of water/g of fibers. Thus, about 2.04 g of water/g of fibers is removed at the nip 38. Given the Basis Weight of the embryonic web 17*a* exiting the nip 38, the volume of water expelled from the embryonic web 17*a* at the nip 38 is determined by the following formula:

$$V_{water\ per\ unit\ area} = \frac{\text{g of water}}{\text{g of fibers}} \times BW \frac{\text{g of fibers}}{\text{cm}^2} \times \frac{1}{\rho_{water}}$$

where:

BW=basis weight of the web exiting the nip 38

$\rho_{water}$=density of water (1 g/cm$^3$)

In order to maximize water removal from the embryonic web 17*a* at the nip 38, the ratio of the volume of water expelled from the embryonic web 17*a* to the absolute void volume of the papermaking belt 10*a* is at least about 0.5. The ratio of the volume of water expelled from the embryonic web 17*a* to the absolute void volume of the papermaking belt 10*a* can be at least about 0.7. In some embodiments, the ratio can be greater than 1.0.

The papermaking belt 10*a* can comprise a woven fabric. As one of skill in the art will recognize, woven fabrics typically comprise warp and weft filaments where warp filaments are parallel to the machine direction and weft filament are parallel to the cross machine direction. The interwoven warp and weft filaments form discontinuous knuckles where the filaments cross over one another in succession. These discontinuous knuckles provide discrete imprinted areas in the embryonic web 17*a* during the papermaking process. As used herein the term "long knuckles" is used to define discontinuous knuckles formed as the warp and weft filaments cross over two or more warp or weft filament, respectively.

The knuckle imprint area of the woven fabric may be enhanced by sanding the surface of the filaments at the warp and weft crossover points. Exemplary sanded woven fabrics are disclosed in U.S. Pat. Nos. 3,573,164 and 3,905,863.

The absolute void volume of a woven fabric can be determined by measuring caliper and weight of a sample of woven fabric of known area. The caliper can measured by placing the sample of woven fabric on a horizontal flat surface and confining it between the flat surface and a load foot having a horizontal loading surface, where the load foot loading surface has a circular surface area of about 3.14 square inches and applies a confining pressure of about 15 g/cm$^2$ (0.21 psi) to the sample. The caliper is the resulting gap between the flat surface and the load foot loading surface. Such measurements can be obtained on a VIR Electronic Thickness Tester Model II available from Thwing-Albert, Philadelphia, Pa.

The density of the filaments can be determined while the density of the void spaces is assumed to be 0 gm/cc. For example, polyester (PET) filaments have a density of 1.38 g/cm$^3$. The sample of known area is weighed, thereby yielding the mass of the test sample. The absolute void volume ($VV_{Absolute}$) per unit area of woven fabric is then calculated by the following formula (with unit conversions where appropriate):

$$VV_{Absolute} = V_{total} - V_{filaments}$$

$$= (tXA) - (m/r)$$

where, $V_{total}$=total volume of test sample (t×A)

$V_{filaments}$=solid volume of the woven fabric equal to the volume of the constituent filaments alone t=caliper of test sample A=area of test sample m=mass of test sample r=density of filaments Relative void volume is determined by the following:

$$VV\,Relative = \frac{VV_{Absolute}}{V_{total}}$$

For the present invention, maximum water removal at the nip 38 can be achieved for a woven fabric where the $VV_{Relative}$ ranges from a low limit of about 0.05, preferably a low limit of 0.10, to a high limit of about 0.45, preferably a high limit of about 0.4. For a sanded woven fabric the high limit of $VV_{Relative}$ is about 0.30.

The $VV_{Absolute}$ of a papermaking belt 10*a* having a resinous knuckle pattern 42 shown in FIG. 3 is determined by immersing a sample of the papermaking belt 10*a* in a bath of melted Polyethylene Glycol 1000 (PEG) to a depth slightly exceeding the thickness of the papermaking belt 10*a* sample. After assuring that all air is expelled from the immersed sample, the PEG is allowed to re-solidify. The PEG above the embryonic web contacting side 11, below the backside 12 and along the edges of the sample of papermaking belt 10*a* is removed from the sample of papermaking belt 10*a* and the sample is reweighed. The difference in weight between the sample with and without PEG is the weight of the PEG filling the absolute void volume of papermaking belt 10*a*. The absolute void volume of and the solid volume of the sample of papermaking belt 10*a* is determined by the following expressions:

$$VV_{Absolute} = \frac{\text{grams of } PEG}{\rho_{PEG}}$$

-continued where $$\rho_{PEG} = \text{density of } PEG$$

$$SV_{Absolute} = V_{Filaments} + V_{Resinous\ Knuckles}$$
$$m_{filaments} + M_{Resinous\ Knuckles}$$
$$= r_{filaments}\ \rho_{Resinous\ Knuckles}$$

where:

$SV_{absolute}$=Absolute Solid Volume $m_{filaments}$=mass of filaments $r_{filaments}$=density of filaments $M_{Resinous\ Knuckles}$=mass of the resinous knuckles $\rho_{Resinous\ Knuckles}$=density of resinous knuckles For the present invention, maximum water removal at the nip 38 can be achieved for a reinforcing structure 44 having a resinous knuckle pattern 42 disposed thereon where the $VV_{Relative}$ ranges from a low limit of about 0.05, preferably a low limit of 0.10, to a high limit of about 0.45, preferably a high limit of about 0.28. Most preferably, the $VV_{Relative}$ for a reinforcing structure 44 having a resinous knuckle pattern 42 disposed thereon is about 0.19.

Papermaking Belt

Referring again to FIG. 3, the papermaking belt 10*a* can be an imprinting fabric that is macroscopically mono-planar. The plane of the imprinting fabric defines its MD/CD (X-Y) directions. Perpendicular to the MD/CD directions and the plane of the imprinting fabric is the Z-direction of the imprinting fabric. Likewise, the embryonic web 17*a* according to the present invention can be thought of as macroscopically mono-planar in the MD/CD plane.

The papermaking belt 10*a* preferably includes a reinforcing structure 44 and a resinous knuckle pattern 42. The resinous knuckle pattern 42 is joined to the reinforcing structure 44. The resinous knuckle pattern 42 extends outwardly from the embryonic web contacting side 13 of the reinforcing structure 44. The reinforcing structure 44 strengthens the resinous knuckle pattern 42 and has suitable projected open area to allow any associated vacuum dewatering machinery employed in a papermaking process to adequately perform the function of removing water from the embryonic web 17*a* and to permit water removed from the embryonic web 17*a* to pass through the papermaking belt 10*a*. The reinforcing structure 44 preferably comprises a woven fabric comparable to woven fabrics commonly used in the papermaking industry for imprinting fabrics. Such imprinting fabrics which are known to be suitable for this purpose are illustrated U.S. Pat. Nos. 3,301,746; 3,905,863; and 4,239,065.

The filaments of an exemplary woven fabric may be so woven and complimentarily serpentinely configured in at least the Z-direction to provide a first grouping or array of coplanar top-surface-plane crossovers of both warp and weft filaments and a predetermined second grouping or array of sub-top-surface crossovers. The arrays are interspersed so that portions of the top-surface-plane crossovers define an array of wicker-basket-like cavities in the top surface of the fabric. The cavities are disposed in staggered relation in both the machine direction and the cross machine direction such that each cavity spans at least one sub-top-surface crossover. A woven fabric having such arrays may be made according to U.S. Pat. Nos. 4,239,065 and 4,191,069.

For a woven fabric the term shed is used to define the number of warp filaments involved in a minimum repeating unit. The term "square weave" is defined as a weave of n-shed wherein each filament of one set of filaments (e.g., wefts or warps), alternately crosses over one and under n−1 filaments of the other set of filaments (e.g. wefts or warps) and each filament of the other set of filaments alternately passes under one and over n−1 filaments of the first set of filaments.

The woven fabric for the present invention is required to form and support the embryonic web 17*a* and allow water to pass through. The woven fabric for the imprinting fabric can comprise a "semi-twill" having a shed of 3 where each warp filament passes over two weft filaments and under one weft filament in succession and each weft filament passes over one warp filament and under two warp filaments in succession. The woven fabric for the imprinting fabric may also comprise a "square weave" having a shed of 2 where each warp filament passes over one weft filament and under one weft filament in succession and each weft filament passes over one warp filament and under one warp filament in succession.

The embryonic web contacting side 11 of papermaking belt 10*a* contacts the embryonic web 17*a* that is carried thereon and is substantially formed by the resinous knuckle pattern 42. Preferably the resinous knuckle pattern 42 defines a predetermined pattern which imprints a like pattern onto the embryonic web 17*a* which is carried thereon. A particularly preferred pattern for the resinous knuckle pattern 42 is an essentially continuous network. If the preferred essentially continuous network pattern is selected for the resinous knuckle pattern 42, discrete deflection conduits 46 will extend between the embryonic web contacting surface 11 and the non-embryonic web contacting surface 12 of the imprinting fabric. The essentially continuous network surrounds and defines the deflection conduits 46. However, one of skill in the art will appreciate that the resinous knuckle pattern 42 can be a substantially or an essentially discontinuous network surrounded by a singular deflection region. Further, one of skill in the art will appreciate that the resinous knuckle pattern 42 can comprise portions that are an essentially discontinuous network and portions that are a substantially or an essentially continuous network. In such a configuration, the essentially discontinuous network and essentially continuous network portions of the resinous knuckle pattern 42 can be immediately adjacent (i.e., in contacting relationship, sharing a common boundary) or can be distinct regions that do not share a common boundary.

Preferably, the resinous knuckle pattern has a plurality of pores 40 disposed therein. The pores 40 of papermaking belt 10*a* are preferably randomly distributed throughout the resinous knuckle pattern 42. It should be realized that the pores 40 are preferably distributed throughout the resinous knuckle pattern 42 in regions that are distinct and/or distal from deflection conduits 46. However, it should also be realized that the random pores 40 may be positioned anywhere within the resinous knuckle pattern 42. The pores 40 can be formed by any means known to those of skill in the art during and/or after formation of resinous knuckle pattern 42.

Each pore 40 is provided with one, or at least one, opening disposed at any location upon the embryonic web contacting surface 11 and one, or at least one, opening disposed at any location upon the backside 12 of papermaking belt 10*a*. Each pore 40 may have any configuration of interconnected pathways between an opening on the embryonic web contacting surface 11 and an opening on the backside 12 of papermaking belt 10*a*. In other words, the pores 40 are randomly distributed and are provided so that any two openings disposed upon the embryonic web contacting surface 11 or the backside 12 of papermaking belt 10*a* may be in fluid communication with each other and are in fluid communication with at least one pore on the opposite side of papermaking belt 10*a*. A pore 40 may be located in a region of resinous knuckle pattern 42 that borders adjacent deflection conduits 46. Each pore 40 is preferably provided with an average diameter that facilitates capillary dewatering of a wet fibrous or embryonic web disposed upon the embryonic web contacting surface 11, but effectively prevents individual fiber deflection into the pore 40. In other words if the individual fiber is provided with an average diameter, no portion of that fiber should extend more than one fiber diameter below the embryonic web contacting surface 11. For purposes of clarity, it is preferred that the individual fiber that has the lowest flexural rigidity within the wet fibrous or embryonic structure be the fiber selected for measurement of the average diameter.

Figure 5:
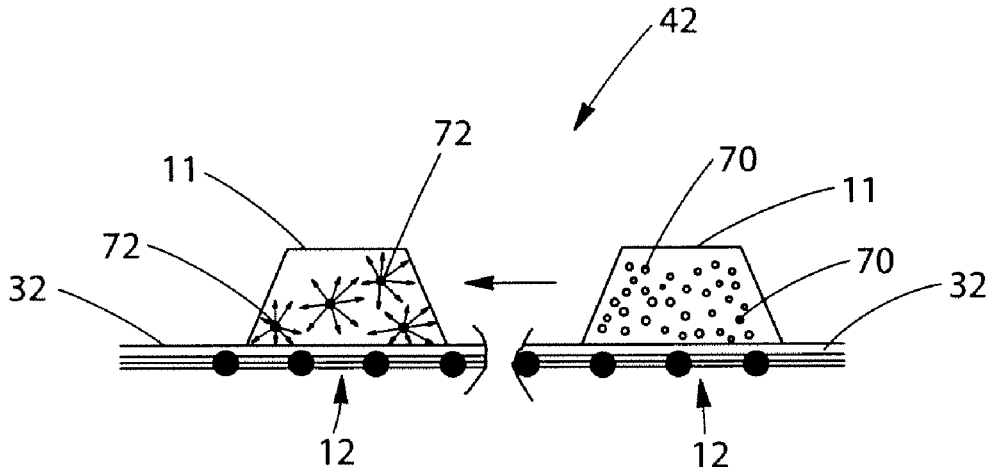
FIG. 5 is a broken, vertical cross-sectional view of a portion of the papermaking belt shown in FIG. 4 showing a blowing agent dispersed within the papermaking belt and the blowing agent being expanded.

As shown in FIG. 5, in one preferred embodiment of the present invention, the random pores 40 can be formed with the use of a blowing agent 70 that is dispersed within the resin forming resinous knuckle pattern 42. A "blowing agent" refers to substances that can produce pores or cells in polymeric compositions. If the cells are formed through a change in the physical state of the substance (e.g., through an expansion of compressed gas, an evaporation of a liquid, or by the dissolution of a solid), the material is a physical blowing agent. This can be accomplished through the use of intermediate chain length alkane-based gasses such as pentanes, hexanes, heptanes, and the like. If the pores 40 are formed by the liberation of gasses as the by-products of the thermal decomposition of a material, the material is a chemical blowing agent. Exemplary but non-limiting chemical blowing agents 70 may include sodium bicarbonates, ammonium nitrites, azo-compounds, and the like. A blowing agent 70 can be dispersed within a resin by the following process.

a. Forming a Mixture of Resin and a Blowing Agent

A stable dispersion of a blowing agent 70 can be formed in the resin by adding a blowing agent 70 to the resin either during or after formation of the resin; dispersing the blowing agent; and stabilizing the dispersion. The blowing agent is dispersed in the resin and stabilized to form a stable discontinuous phase of the blowing agent (i.e., "particles" of blowing agent) in the resin mixture phase. The blowing agent 70 particles are preferably free of the monomer, internal cross-linking agents, and solvents.

Suitable blowing agents may include any conventional blowing agent that is substantially insoluble in a solvent and has a controlled and stabilized particle size when dispersed in the resin. Additionally, the blowing agent should be capable of controlled expansion. Suitable blowing agents 70 may have a vaporization temperature (i.e., boiling point) that is less at a given pressure than the vaporization temperature of the solvent. The blowing agent preferably has a boiling point that is less than the critical temperature, to allow sufficient expansion of the blowing agent 70 before curing. Exemplary but non-limiting blowing agents are disclosed in Chemical Encyclopedia, H. Lasman, National Polychemicals, Inc., Vol. 2 on page 534.

The blowing agent 70 may be dispersed by applying shear stress (e.g., through high shear mixing) to the reaction mixture and, if necessary, by controlling the viscosity ratio of the blowing agent phase to the reaction mixture phase (as used herein, the viscosity ratio refers to the viscosity of the blowing agent phase divided by the viscosity of the reaction mixture phase) by using a surfactant. The dispersion process is controlled to obtain a desired blowing agent particle size. The particle size of the dispersed blowing agent 70 influences the cell size (including cell size distribution), the intercommunication of the resulting channels, and the surface area to mass ratio of the resulting resinous knuckle pattern 42.

Particle size influencing features may include the shear rate, surfactant type, the viscosity ratio, and the isotropy of the reaction mixture. Preferably, these features are controlled to minimize the size of the blowing agent 70 particle. Preferably, the dispersed blowing agent 70 has a particle size of less than about 10 μM, or less than about 5 μM, or less than about 2 μM. The minimum particle size can be about 0.1 μM.

To obtain a relatively small blowing agent 70 particle size, it may be preferred to use a relatively high shear stress for dispersing the blowing agent 70. In general, the higher the rate of shear, the smaller the average particle size of the blowing agent 70. Where particles of substantially uniform size are desired, it is typically preferred to have uniform shear throughout the mixture.

For a given reaction mixture, blowing agent, temperature, and shear stress, the particle size of the blowing agent 70 typically decreases as the viscosity ratio of the dispersed blowing agent 70 phase to the continuous resin phase is decreased. As the viscosity ratio decreases, the blowing agent 70 particle size is more readily controlled to a smaller particle size. Therefore, it is generally preferred to minimize the viscosity ratio. A preferred viscosity ratio is less than about 0.5 and more preferably less than about 0.25.

b. Stabilizing the Resin/Blowing Agent Mixture

The dispersion having the desired blowing agent 70 particle size is preferably stabilized prior to the expansion and reaction steps to form the resin that forms the resinous knuckle pattern 42. Preferably, stabilization occurs simultaneously with dispersion. "Stable" and/or "stabilized" means that the desired particle size of the dispersed blowing agent 70 is maintained for a sufficient time to allow the resin to form with the desired morphology (e.g., substantially continuous intercommunicating channels substantially throughout the resinous knuckle pattern 42 and a relatively small cell size, low density, and high surface area to mass ratio).

Any method of stabilizing the dispersion may be employed. Preferably, a surfactant can be used to stabilize the dispersion. Generally, a more stable dispersion is formed by small and uniform the blowing agent 70 particles. Stabilization may be aided by controlling the viscosity ratio. Generally, the lower the viscosity ratio at a given shear, the smaller the blowing agent 70 particle size and the more stable the dispersion.

c. Expanding the Blowing Agent

Returning to FIG. 5, the expansion 72 of the blowing agent 70 is controlled to provide a resinous knuckle pattern 42 having substantially continuous intercommunicating channels substantially throughout the resinous knuckle pattern 42, an average cell size of less than about 100 μM, a surface area to mass ratio of at least about 0.2 $m^2/g$, and a density of less than about 0.5 $g/cm^3$.

Figure 6:
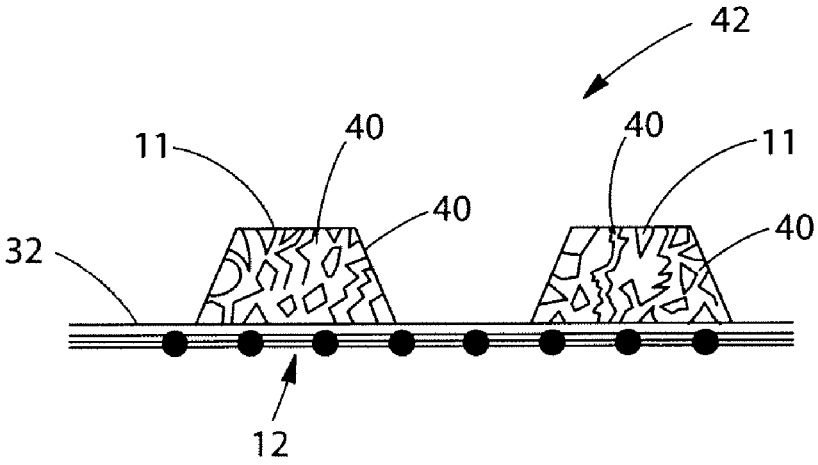
FIG. 6 is a vertical cross-sectional view of a portion of an exemplary papermaking belt showing the open-cell structure resulting from the blowing agent being expanded.

As shown in FIG. 6, the blowing agent 70 particles of the stabilized dispersion are expanded to avoid excessive coalescence of the blowing agent 70 as it expands (i.e., the blowing agent 70 particles generally expand in relative proportion to their initial stabilized particle size and shape in the dispersion). Typically, the blowing agent 70 particles are expanded to about 10 times their original size. Expansion 72 of the blowing agent 70 results in the random formation of pores 40. The pores are formed by the expansion 72 of adjacent portions of blowing agent 70 in a concomitant manner into a portion of the region created by the expansion of an adjacent portion of blowing agent 70.

d. Controlling the Dispersion, Stabilization, and Expansion Steps

It is generally preferred to expand 72 the blowing agent 70 as slowly as possible. Typically, the blowing agent 70 is expanded 72 to form pores 40 by heating the stable dispersion to the vaporization temperature of the blowing agent 70 at a rate of less than about 1° C./minute, more preferably less than about 0.5° C./minute, most preferably less than about 0.1 to about 0.2° C./minute. The rate of heating may be increased if a counter-pressure is applied to the dispersion in order to achieve substantially the same rate of expansion as where only the temperature is increased at the preferred rates. Alternatively, where a decrease in pressure is used to expand the blowing agent 70, a corresponding (at a given temperature) controlled rate of decreasing pressure may be used to form the expanded structure of the resulting resinous knuckle pattern 42.

The projected surface area of the continuous embryonic web contacting side 11 preferably provides from about 5% to about 80%, more preferably from about 25% to about 75%, and even more preferably from about 50% to about 65% of the projected area of the embryonic web 17*a* contacting the embryonic web contacting side 11 of the papermaking belt 10*a*.

The reinforcing structure 44 provides support for the resinous knuckle pattern 42 and can comprise of various configurations. Portions of the reinforcing structure 44 can prevent fibers used in papermaking from passing completely through the deflection conduits 46 and thereby reduces the occurrences of pinholes. If one does not wish to use a woven fabric for the reinforcing structure 44, a non-woven element, screen, scrim, net, or a plate having a plurality of holes therethrough may provide adequate strength and support for the resinous knuckle pattern 42 of the present invention.

The papermaking belt 10*a* having the resinous knuckle pattern 42 disposed thereon according to the present invention may be made according to any of the following U.S. Pat. Nos. 4,514,345; 4,528,239; 5,098,522; 5,260,171; 5,275,700; 5,328,565; 5,334,289; 5,431,786; 5,496,624; 5,500,277; 5,514,523; 5,554,467; 5,566,724; 5,624,790; 5,714,041; and, 5,628,876.

The caliper of the woven fabric may vary, however, in order to facilitate the hydraulic connection between the embryonic web 17*a* and the capillary dewatering member 60 the caliper of the imprinting fabric may range from about 0.011 inch (0.279 mm) to about 0.026 inch (0.660 mm).

Preferably, the resinous knuckle pattern 42 extends outwardly (i.e., has an overburden) from the reinforcing structure 44 a distance less than about 0.15 mm (0.006 inch), more preferably less than about 0.10 mm (0.004 inch) and still more preferably less than about 0.05 mm (0.002 inch), and most preferably less than about 0.1 mm (0.0004 inch). The resinous knuckle pattern 42 can be substantially coincident (or even coincident) with the elevation of the reinforcing structure 44. By having the resinous knuckle pattern 42 extending outwardly such a short distance from the reinforcing structure 44, a softer product may be produced. Specifically, the short distance provides for the absence of deflection or molding of the paper into the imprinting surface of the imprinting fabric as occurs in the prior art. Thus, the resulting paper can be provided with a smoother surface and less tactile roughness.

Furthermore, by having the resinous knuckle pattern 42 extend outwardly from the reinforcing structure 44 such a short distance, the reinforcing structure 44 can contact the embryonic web 17 at the top surface of the knuckles disposed within the deflection conduits 46. This arrangement can further compact the embryonic web 17*a* at the points coincident the embryonic web contacting side 11 of the resinous knuckle pattern 42 against the Yankee drying drum 28 thus decreasing the MD/CD spacing between compacted regions. More frequent and closely spaced contact between the embryonic web 17*a* and the Yankee drying drum 28 may occur. One of the benefits of the present invention is that the imprinting of the embryonic web 17*a* and transfer to a Yankee drying drum 28 may occur nearly simultaneously, eliminating the multi-operational steps involving separate compression nips of the prior art. Also, by transferring substantially full contact of the embryonic web 17*a* to the Yankee drying drum 28—rather than just the imprinted region as occurs in the prior art—full contact drying can be obtained.

Fibers making up the embryonic web 17*a* are typically oriented in the MD/CD plane and provide minimal structural support in the Z-direction. Thus, as the embryonic web 17*a* is compressed by the papermaking belt 10*a*, the embryonic web 17*a* is compacted creating a patterned, high density region that is reduced in thickness. Conversely, portions of the embryonic web 17*a* covering the deflection conduits 46 are not compacted and as a result, thicker, low density regions are produced. These low density regions, (i.e., domes) can give the embryonic web 17*a* an apparent thickness. However, the domes may be susceptible to deformation and reduced thickness during subsequent papermaking operations. Thus, the caliper of the embryonic web 17*a* may be limited by the domes' ability to withstand a mechanical pressure.

Additionally, the physical properties of an embryonic paper web 17*a* can be influenced by the orientation of fibers in the MD/CD plane. For instance, a web 27 having a fiber orientation which favors MD, has a higher tensile strength in MD than in CD, a higher stretch in CD than in MD, and a higher bending stiffness in MD than in CD. The web tensile strength is also proportional to the corresponding lengths of fibers oriented in a particular direction in the X-Y plane. Web tensile strength in the MD/CD is proportional to the mean fiber lengths in the MD/CD. Fibers 50 accumulating at a resin/deflection conduit interface can have a Z-direction component that enables them to provide the support structure capable to withstand external compressive forces. Fibers oriented parallel to the Z-direction at the interface can provide maximum support.

Figure 7:
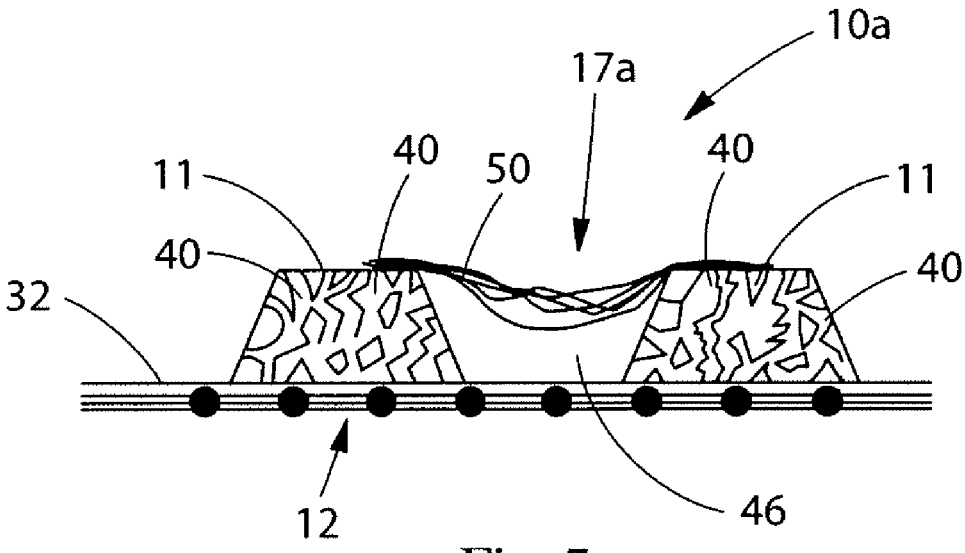
FIG. 7 is a vertical cross-sectional view of a portion of the papermaking belt shown in FIG. 6 depicting fibers bridging the deflection conduit and across the random pores disposed within the resinous knuckle pattern; and, FIG. 8 is a vertical cross-sectional view of a portion of the papermaking belt shown in FIG. 6 depicting fibers collecting at the bottom of the deflection conduit and across the random pores disposed within the resinous knuckle pattern.

Referring to FIG. 7, deflection conduits 46 and random pores 40 can provide a means for deflecting fibers in the Z-direction. Fiber deflection produces a fiber orientation which includes a Z-direction component. Such fiber orientation not only creates an apparent web thickness but can also provide Z-direction structural rigidity which can assist the embryonic paper web 17*a* to maintain thickness throughout processing. Accordingly, for the present invention, deflection conduits 46 are preferably sized and shaped to maximize fiber deflection.

Figure 8:
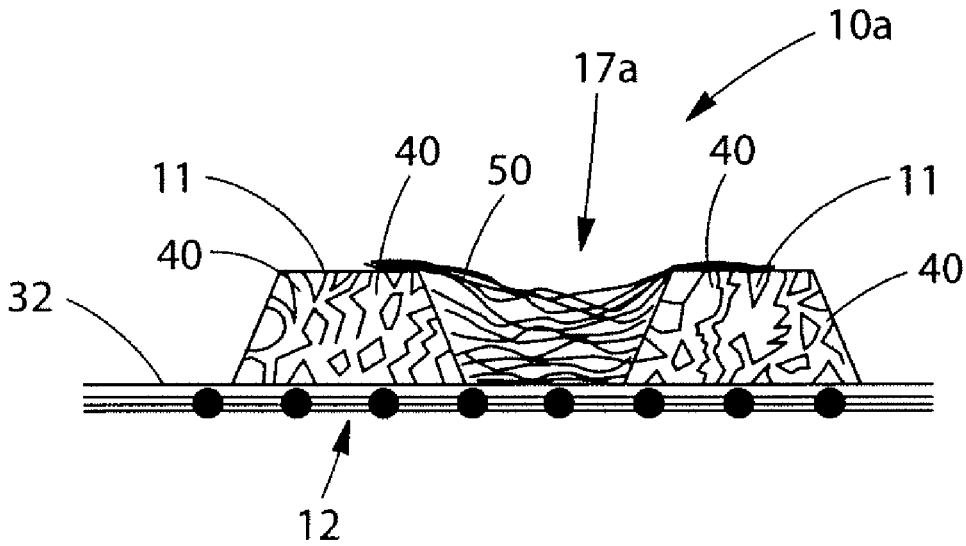

As shown in FIG. 8, water removal from the embryonic web 17*a* begins as fibers 50 are deflected into the deflection conduits 46 and conform to the surface of resinous knuckle pattern 42. It is believed that providing random pores 40 within the resinous knuckle pattern 42 can provide additional capillary action to increase water removal from the embryonic web 17*a* in regions distal from deflection conduits 46 by decreasing the path distance between the paper-contacting side 11 and backside 12 of the papermaking belt 10*a*. This facilitates regions of the resinous knuckle pattern 42 distal from a deflection conduit 46 to thermodynamically compete in the removal of water from embryonic web 17 or intermediate web 19 by increasing the surface area to volume of the resinous knuckle pattern 42. It is also believed that enhanced water removal can result in decreased fiber mobility which may 'fix' the fibers in place after deflection and rearrangement.

Deflection of the fibers into the deflection conduits 34 and conformation to the surface of resinous knuckle pattern 42 can be induced by the application of differential fluid pressure to the embryonic web 17*a*. One preferred method of applying differential pressure is by exposing the embryonic web 17*a* to a vacuum through both deflection conduits 46 and pores 40.

Capillary Dewatering Member

The capillary dewatering member 60 can be a dewatering felt. The dewatering felt is macroscopically mono-planar. The plane of the dewatering felt defines its X-Y directions. Perpendicular to the X-Y directions and the plane of the dewatering felt is the Z-direction of the second lamina.

A suitable dewatering felt comprises a non-woven batt of natural or synthetic fibers joined, such as by needling, to a secondary base formed of woven filaments. The secondary base serves as a support structure for the batt of fibers. Suitable materials from which the non-woven batt can be formed include but are not limited to natural fibers such as wool and synthetic fibers such as polyester and nylon. The fibers from which the batt is formed can have a denier of between about 3 and about 20 grams per 9000 meters of filament length.

The dewatering felt can have a layered construction, and can comprise a mixture of fiber types and sizes. The layers of felt are formed to promote transport of water received from the web contacting surface of the papermaking belt 17*a* away from a first felt surface and toward a second felt surface. The felt layer can have a relatively high density and relatively small pore size adjacent the felt surface in contact with the backside 12 of the papermaking belt 10*a* as compared to the density and pore size of the felt layer adjacent the felt surface in contact with the impression nip roll 16*a*.

The dewatering felt can have an air permeability of between about 5 and about 300 cubic feet per minute (cfm) (0.002 $m^3$/sec-0.142 $m^3$/sec) with an air permeability of less than 50 cfm (0.24 $m^3$/sec) being preferred for use with the present invention. Air permeability in cfm is a measure of the number of cubic feet of air per minute that pass through a one square foot area of a felt layer, at a pressure differential across the dewatering felt thickness of about 0.5 inch (12.7 mm) of water. The air permeability is measured using a Valmet permeability measuring device (Model Wigo Taifun Type 1000) available from the Valmet Corp. of Helsinki, Finland.

If desired, other capillary dewatering members may be used in place of the felt described above. For example, a foam capillary dewatering member may be selected. Such a foam capillary dewatering member has an average pore size of less than 50 microns. Suitable foams may be made in accordance with U.S. Pat. Nos. 5,260,345 and 5,625,222.

Alternatively, a limiting orifice drying medium may be used as a capillary dewatering member. Such a medium may be made of various laminae superimposed in face-to-face relationship. The laminae have an interstitial flow area smaller than that of the interstitial areas between fibers in the paper. A suitable limiting orifice drying member may be made in accordance with U.S. Pat. Nos. 5,625,961 and 5,274,930.

Paper Product

The paper product produced according to the present invention is macroscopically mono-planar where the plane of the paper defines its X-Y directions and having a Z direction orthogonal thereto. A paper product produced according to the apparatus and process of the present invention has at least two regions. The first region comprises an imprinted region which is imprinted against the resinous knuckle pattern 42 of the papermaking belt 10*a*. The imprinted region is preferably an essentially continuous network. The second region of the paper comprises a plurality of domes dispersed throughout the imprinted region. The domes generally correspond to the position to the position of the deflection conduits 46 disposed in the papermaking belt 10*a*.

By conforming to the deflection conduits 46 disposed within an essentially continuous resinous knuckle pattern 42 during the papermaking process, the fibers in the domes are deflected in the Z-direction between the embryonic web contacting surface 11 and the paper facing surface of the reinforcing structure 44 and the fiber proximate to the resinous knuckle pattern 42 are compressed in the Z-direction against the embryonic web contacting surface 11. As a result, the domes are preferably discrete and isolated one from another by the continuous network region formed by the resinous knuckle pattern 42 and protrude outwardly from the essentially continuous network region of the resulting embryonic web 17*a* and/or intermediate web 19. One of skill in the art will recognize that if an essentially discontinuous resinous knuckle pattern 42 or a combination of continuous and discontinuous resinous knuckle patterns 42 are used, the domes of the resulting intermediate web 19 corresponding to the deflection conduits 42 will protrude outwardly from whatever resinous knuckle pattern 42 is used.

Without being bound by theory, it is believed the domes and the essentially continuous network regions of the intermediate web 19 may have generally equivalent basis weights. By deflecting the domes into the deflection conduits 46, the density of the domes is decreased relative to the density of the essentially continuous network region corresponding to the resinous knuckle pattern 42. Moreover, the essentially continuous network region (or other pattern as may be selected) may later be imprinted for example, against a Yankee drying drum 28 of papermaking machine 20*a*. Such imprinting can increase the density of the essentially continuous network region relative to the domes. The resulting intermediate web 19 may be later embossed as is well known in the art.

The first region can comprise a plurality of imprinted regions. The first plurality of regions lie in the MD/CD plane and the second plurality of regions extend outwardly in the Z-direction. The second plurality of regions has a lower density than the first plurality of regions. The density of the first and second regions can be measured according to U.S. Pat. Nos. 5,277,761 and 5,443,691.

The shapes of the domes in the MD/CD plane include, but are not limited to, circles, ovals, and polygons of three or more sides which would correspond to deflection conduits 46 having corresponding circles, ovals, and polygons of three or more sides geometries. Preferably, the domes are generally elliptical in shape comprising either curvilinear or rectilinear peripheries. A curvilinear periphery comprises a minimum radius of curvature such that the ratio of the minimum radius of curvature to mean width of the dome ranges from at least about 0.29 to about 0.50. A rectilinear periphery may comprise of a number of wall segments where the included angle between adjacent wall segments is at least about 120 degrees.

Providing a paper having high caliper can require maximizing the number Z-direction fibers per unit area in the intermediate web 19. The majority of the Z-direction fibers are oriented along the periphery of the domes where fiber deflection occurs. Thus, Z-direction fiber orientation and corresponding caliper of the intermediate web 19 can be dependent on the number of domes per unit area.

The number of domes per unit area of the intermediate web 19 can be dependent on the size and shape of the deflection conduits 46. A preferred mean width of the domes is at least about 0.043 inches and less than about 0.129 inches. A preferred elliptical shape for the domes has an aspect ratio ranging from 1 to about 2, more preferably from about 1.3 to 1.7, and most preferably from about 1.4 to about 1.6.

The intermediate web 19 may also be foreshortened, as is known in the art. Foreshortening can be accomplished by creping the intermediate web 19 from a rigid surface such as a drying cylinder. A Yankee drying drum 28 can be used for this purpose. During foreshortening, at least one foreshortening ridge can be produced in the second plurality of regions (the domes of the intermediate web 19). Such at least one foreshortening ridge is spaced apart from the MD/CD plane of the intermediate web 19 in the Z-direction. Creping can be accomplished with a doctor blade according to U.S. Pat. No. 4,919,756. Alternatively or additionally, foreshortening may be accomplished via wet micro-contraction as taught in U.S. Pat. No. 4,440,597.

Any dimension and/or value disclosed herein is not to be understood as strictly limited to the exact numerical values recited. Instead, unless otherwise specified, each dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A papermaking belt having an embryonic web contacting surface for carrying an embryonic web of paper fibers and a non-embryonic web contacting surface opposite said embryonic web contacting surface, said papermaking belt comprising:

a reinforcing structure having a patterned framework disposed thereon, said patterned framework comprising a continuous network region and a plurality of discrete deflection conduits, said deflection conduits isolated one from another by said continuous network region; and, a plurality of pores randomly disposed within said continuous network region, said pores having one opening disposed upon said embryonic web contacting surface and one opening disposed upon said non-embryonic web contacting surface, each of said pores providing at least one pathway between said embryonic web contacting surface and said non-embryonic web contacting surface and said plurality of pores providing said continuous network region with an open-cell structure.

2. The papermaking belt of claim 1 wherein said pores increase the permeability of said continuous network region.

3. The papermaking belt of claim 1 wherein said open cell structure has an average pore size ranging from about 1 μM to about 1.00 μM.

4. The papermaking belt of claim 3 wherein said open-cell structure has an average pore size ranging from about 2 μM to about 50 μM.

5. The papermaking belt of claim 4 wherein said open-cell structure has an average pore size ranging from about 5 μM to about 20 μM.

6. The papermaking belt of claim 1 wherein said plurality of pores increase the surface area to volume available for the removal of water from said embryonic web of paper fibers disposed upon said embryonic web contacting surface in areas distal from said discrete deflection conduits.

7. The papermaking belt of claim 1 wherein said plurality of pores is formed by activation of a blowing agent disposed in said continuous network region.

8. A papermaking belt having an embryonic web contacting surface for carrying an embryonic web of papermaking fibers and a non-embryonic web contacting surface opposite thereto, said papermaking belt comprising:

a reinforcing structure having a patterned framework disposed thereon, said patterned framework comprising a continuous network region and a plurality of discrete deflection conduits, said deflection conduits isolated one from another by said continuous network region;

a blowing agent disposed within said continuous network region; and, wherein activation of said blowing agent forms a plurality of random pores within said continuous network region, said pores haying at least one opening disposed upon said embryonic web contacting surface and at least one opening disposed upon said non-embryonic web contacting surface, each of said pores defining at least one pathway between said embryonic web contacting surface and said non-embryonic web contacting surface.

9. The papermaking belt of claim 8 wherein said pores increase the permeability of said continuous network region.

10. The papermaking belt of claim 8 wherein said plurality of pores provides said continuous network region with an open-cell structure.

11. The papermaking belt of claim 10 wherein said open-cell structure has an average pore size ranging from about 1 μM to about 100 μM.

12. The papermaking belt of claim 11 wherein said open-cell structure has an average pore size ranging from about 2 μM to about 50 μM.

13. The papermaking belt of claim 12 wherein said open-cell structure has an average pore size ranging from about 5 μM to about 20 μM.

14. The papermaking belt of claim 8 wherein said plurality of pores increase the surface area to volume available for the removal of water from said embryonic web of paper fibers disposed upon said embryonic web contacting surface in areas distal from said discrete deflection conduits.

15. A papermaking belt having an embryonic web contacting surface for carrying an embryonic web of papermaking fibers and a non-embryonic web contacting surface opposite thereto, said papermaking belt comprising:

a reinforcing structure having a patterned framework disposed thereon, said patterned framework comprising a continuous network region and a plurality of discrete deflection conduits, said deflection conduits isolated one from another by said continuous network region; and, a plurality of pores randomly disposed within said continuous network region, said pores having at least one opening disposed upon said embryonic web contacting surface and at least one opening disposed upon said non-embryonic web contacting surface, each of said pores providing at least one pathway between said embryonic web contacting surface and said non-embryonic web contacting surface and said plurality of pores providing said continuous network region with an open-cell structure.

16. The papermaking belt of claim 15 wherein said open-cell structure has an average pore size ranging from about 1 μM to about 100 μM.

17. The papermaking belt of claim 16 wherein said open-cell structure has an average pore size ranging from about 2 μM to about 50 μM.

18. The papermaking belt of claim 15 wherein said plurality of pores is formed by activation of a blowing agent disposed in said continuous network region.

* * * * *

UNITED STATES PATENT AND TRADEMARK OFFICE

CERTIFICATE OF CORRECTION

PATENT NO. : 8,282,783 B2
APPLICATION NO. : 12/772320
DATED : October 9, 2012
INVENTOR(S) : Dean Van Phan It is certified that error appears in the above-identified patent and that said Letters Patent is hereby corrected as shown below:

Column 17

Line 61, claim 4, replace “1.00” with “100”.

Column 18

Line 23, claim 9, replace “haying” with “having”.

Signed and Sealed this
Ninth Day of April, 2013

Teresa Stanek Rea
*Acting Director of the United States Patent and Trademark Office*